US007987897B2

(12) United States Patent
Anisimov et al.

(10) Patent No.: US 7,987,897 B2
(45) Date of Patent: Aug. 2, 2011

(54) METHOD FOR MAKING CASTINGS BY DIRECTED SOLIDIFICATION FROM A SELECTED POINT OF MELT TOWARD CASTING PERIPHERY

(76) Inventors: Oleg Vladimirovich Anisimov, Moscow (RU); Yury Valeryevich Shtankin, Moscow (RU)

( * ) Notice: Subject to any disclaimer, the term of this patent is extended or adjusted under 35 U.S.C. 154(b) by 347 days.

(21) Appl. No.: 12/380,357

(22) Filed: Feb. 26, 2009

(65) Prior Publication Data

US 2009/0242166 A1 Oct. 1, 2009

(30) Foreign Application Priority Data

Mar. 27, 2008 (RU) ..... 2008111707

(51) Int. Cl.
*B22D 27/08* (2006.01)
*B22D 27/04* (2006.01)
*C22F 3/02* (2006.01)

(52) U.S. Cl. ..... 164/501; 164/71.1; 164/122

(58) Field of Classification Search ..... 164/71.1, 164/122, 501
See application file for complete search history.

(56) References Cited

U.S. PATENT DOCUMENTS 4,291,742 A * 9/1981 Korytov et al. ..... 164/501
5,305,817 A * 4/1994 Borisov et al. ..... 164/97

FOREIGN PATENT DOCUMENTS

JP 2006102807 A * 4/2006
SU 1424952 9/1988

* cited by examiner

*Primary Examiner* — Jessica L Ward
*Assistant Examiner* — Kevin E Yoon
(74) *Attorney, Agent, or Firm* — Collard & Roe, P.C.

(57) ABSTRACT

The invention is related to the foundry practice. According to this invention, the method for making castings by directed solidification from a selected point of the melt toward the periphery of the casting comprises forming a casting in a mold having thermodynamic characteristics that allow uniform volume cooling of the melt to be effected to a temperature at which natural solidification processes are completed. To improve the structural isotropy of the casting formed, the cooling is effected at a rate not exceeding 0.5° C./sec. The casting is formed in a nonuniform field of force. The nonuniform field of force is set up by ultrasonic waves focused on a selected point of the melt to form therein a localized elevated pressure zone and to direct the solidification front from the zone toward the periphery of the casting. The nonuniform field of force is sustained in the mold until the cooling casting reaches a temperature at which the natural melt solidification processes are completed as the melt cools. Before the melt is poured into the mold, it is overheated to a level that, together with the thermodynamic characteristics of the mold allowing the melt therein to be cooled at a rate not exceeding 0.5 K/sec, sustains the liquid phase of the melt for a time sufficient for directed melt solidification to be effected from the selected point of the melt toward the periphery of the casting before the commencement of natural melt solidification processes as the melt cools. Subsequently, as the temperature at which natural solidification processes are completed is reached, the nonuniform field of force is removed, and casting cooling may continue at any reasonable rate.

4 Claims, 3 Drawing Sheets

METHOD FOR MAKING CASTINGS BY DIRECTED SOLIDIFICATION FROM A SELECTED POINT OF MELT TOWARD CASTING PERIPHERY

CROSS REFERENCE TO RELATED APPLICATIONS

Applicants claim priority under 35 U.S.C. §119 of Russian Application No. 2008111707 filed on Mar. 27, 2008.

FIELD OF THE INVENTION

The invention is related to the foundry practice, and particularly to methods for making castings by directed solidification of the melt.

BACKGROUND OF THE INVENTION

The need to effectively control solidification of a metal melt in a mold to make castings with acceptable practical service properties forces researchers and engineers to look constantly for new approaches in order to radically improve the quality of castings because castings acquire their basic service properties at the crystalline structure solidification stage.

Until recently, all methods for controlling processes developing during solidification of metal melts have been confined to influencing the thermal processes within the melt and at the heat exchange boundary. In this environment, the two-phase solidification front zone forming at the casting periphery obstructs removal of latent heat as it moves toward the center at a slowing rate, causing variation in the grain size and raising pressure within the melt as the contracting solid phase grows, and in this way provoking the release of dissolved gases into the melt. This organization of the solidification process is ineffective, to an extent, and results, no matter what option is used, in the casting grain size developing a gradient and hence anisotropy of properties. Moreover, when solidification is effected by heat removal, defects such as micro- and macro-voids and various forms of liquation cannot be avoided. Attempts are made to offset the structural defects of castings made by an existing method in which the melt is solidified from the periphery to the center thereof. A good example of this is a method in which a fine structure is produced by activating the melt with various impurities, mostly those having a higher melting point, the particles thereof serving as solidification centers. It is appropriate to interpret the mechanism in which solidification centers are formed as operation of "micro-refrigerators." More refractory inclusions have a stable crystalline structure at solidification temperatures of the host metal, and their atoms are able to "take away" some of the energy from the melt components in localized zones of the melt. This "take-away" energy creates conditions favorable enough to begin solidification in these zones.

A similar solidification mechanism develops when various alloys are used to "multiply" their structure within the melt, a process now known as "heredity." Whatever the method used to produce alloys, they have a structure fragmented considerably and have a slightly higher melting point than the host metal because of large contact surface areas of their components. Accordingly, dissolution of a partially molten alloy in the host metal, if slightly overheated, results in more solidification centers developing as in the example described above. Use of alloys, as also addition of a modifier to complete volume solidification to produce a fragmented structure gives rise to several problems. Production of a desired structure is influenced significantly by various parameters such as temperature, dissolution quality, distribution of alloy components over the melt volume, and a few other factors. Many research projects are centered on these problems. Also, excessive pressure is produced within the melt, for example, in a thermostatic gas chamber. In this example, interatomic distances are reduced, and interaction energy rises. Since, however, excessive pressure is built in all examples within the entire volume of the melt, and heat is removed, as it has been before, from the surface, the solidification front is directed from the periphery to the center, causing all possible casting defects typical of prior art methods. The only advantage to be gained from this method is possibly improved mold filling and an insignificant improvement in casting structure uniformity.

An analysis of defects developing during solidification suggests a conclusion that they ultimately result from the method in which solidification is conducted by removing heat from the casting surface.

Indeed, the solid peripheral phase, like the solidification front as well, shuts off the accompanying gas phase inside, contributing to blistering, cracking, liquation, and so on.

A method is, however, known in the art to be used for making castings by directed solidification of the melt (U.S. Pat. No. 1,424,952), wherein a casting is formed in a nonuniform field of force of a rotating mold as the melt volume is cooled in its entirety (rather than in a selected direction). The mold rotation speed is chosen in this case so as to expose the melt to a pressure required to overcool the melt to the extent equal to the interval of its metastability. In these conditions, undirected cooling of the melt causes solidification thereof to be directed from the periphery toward the rotation axis of the mold. This effect is achieved by the solidification temperature rising under the influence of pressure built up in the peripheral zones of the melt, being higher than pressure in zones closer to the rotation axis of the mold.

To put this method into practice, however, a high pressure is to be built up with the possibility of the casting mold containing the melt being broken.

Moreover, the constant rotation speed of the mold to produce the desired pressure results in anisotropy of the casting structure and strength characteristics because the solidification front shifts as overcooling decreases continuously toward the rotation axis of the mold.

Accordingly, the conclusion that can be drawn from the above is that a localized elevated pressure zone produced in the casting volume could allow solidification to be controlled effectively from that zone toward the casting periphery. A solidification front moving from that zone toward the periphery could allow gas pockets and unbound intermetallic compounds to be pushed out to the casting surface, prevent development of shrinkage cracks, blisters, and so on.

SUMMARY OF THE INVENTION

The present invention is aimed at resolving a technical problem, which consists in developing a method for making castings in a mold by setting up and maintaining a melt solidification front directed from a selected point within the melt toward the casting periphery in order to improve the strength characteristics of the casting and achieve isotropy of its properties.

This technical results is achieved by a method for making castings by directed melt solidification from a selected point toward the periphery, wherein a casting is formed in a nonuniform field of force of the mold that is generated by ultrasonic waves focused on the selected point within the melt in order to produce a localized elevated pressure zone at that point and to direct the melt solidification front from that zone toward the periphery of the casting.

The thermodynamic characteristics (lining and/or heating) of the mold contribute to a uniform volume cooling of the melt poured into the mold until the natural melt solidification processes are completed as the melt cools. To achieve a better isotropy of the resulting casting structure, cooling is effected at a rate not exceeding 0.5° C./sec.

The desired overheating value of the melt poured into the mold at a uniform volume cooling effected at a rate not exceeding 0.5 K/sec allows the liquid melt phase to be maintained for a time sufficient to complete directed solidification from the selected melt point toward the casting periphery until natural melt solidification processes begin as the melt cools.

The nonuniform field of force is maintained to a temperature at which the natural melt solidification processes are completed as the melt cools. After the casting has cooled in the mold to a temperature at which the natural melt solidification processes are completed as the melt cooled, the nonuniform field of force is removed, and the casting can then be cooled at any desired rate.

These are essential characteristics that add up a stable combination of features sufficient to produce the desired technical effect.

DESCRIPTION OF THE DRAWINGS

The present invention will be clear from the description of a specific embodiment thereof, which is not, however, an exclusively possible embodiment and only illustrates the manner in which the desired technical result can be achieved. The invention in shown in the following drawings.

DESCRIPTION OF AN EMBODIMENT OF THE INVENTION

In principle, a directed solidification method consists in making use of a physical phenomenon that can control reduction in the energy state of a melt to a level where solidification begins. Until recently, practically all solidification control methods have been confined to influencing the thermal processes occurring in the melt. To do so, apparatuses maintaining desired temperature gradients in the melt were used for solidification control purposes. Directed heat removal at desired intensity allows preferred conditions to be created for initiating solidification in a desired zone of the melt, which is actually the most widespread form of directed solidification. This directed solidification option is effective enough if applied to castings of small size. This limitation is explained by the fact that the temperature field within the melt is distorted during melt solidification, releasing latent solidification heat in the process, that is, it distorts (reduces) the temperature gradients existing in the melt. Moreover, solidification front movement from the periphery toward the center creates conditions for voids and other common casting defects adversely affecting casting structure to develop. The present invention allows directed solidification to be conducted effectively in a mold lined or heated for uniform volume (undirected) cooling of a slightly overheated melt at a rate not exceeding 0.5° C./sec by producing a local elevated pressure zone at a selected point of the melt volume to initiate solidification at that point, and then moving the solidification front from the center to the periphery of the casting. In this case, the extent of overheating allows the liquid phase of the melt to exist for a time sufficient for prioritizing directed solidification before the commencement of natural solidification processes in the melt as it cools. A local elevated pressure can be produced by ultrasonic waves capable of generating standing wave antinodes in virtually any substance.

Figure 4:
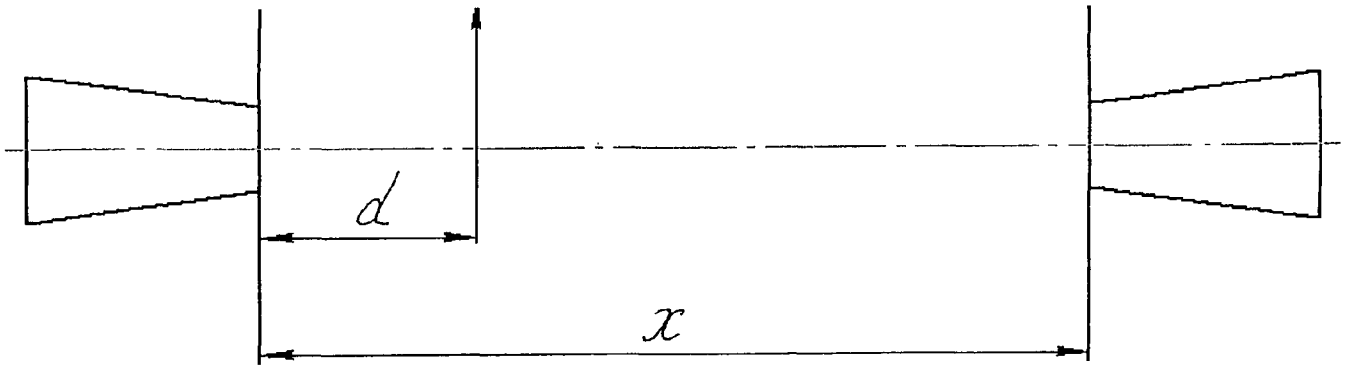
FIG. 4 is a schematic diagram of a mold equipped with ultrasonic transmitters.

To produce such a zone, it is preferred to use pressure antinodes of two focused interfering coherent waves propagating at speeds $U_1$ and $U_2$ (see: Diagram in FIG. 4):

$$U_1=A_1 \sin \omega(t+d/c) \tag{1}$$

$$U_2=A_2 \sin [\omega(t+(x-d)/c)+\phi] \tag{2}$$

wherein:

$A_1$ and $A_2$ are amplitudes of both ultrasonic waves;

c is the propagation speed of an ultrasonic wave in the melt;

ω is the circular frequency of carrier ultrasonic waves;

ϕ is the initial phase;

x is the distance between the opposite transmitters;

d is the distance between one transmitter and the irradiated point; and t is current time.

If attenuation of ultrasonic waves in the melt is neglected, the condition for producing a pressure antinode in a selected zone (standing wave) is described as follows:

$$\phi=[\omega(2d-x)/c]-\pi \tag{3}$$

The last formula allows solidification to be shifted to any zone within the melt by adapting the process to changes in the propagation speed of ultrasonic waves during solidification.

The ultrasonic wave amplitudes $A_1$ and $A_2$ build up a pressure P in this zone (standing wave antinode), increasing the density p of the melt that reaches a maximum value at point d.

Figure 1:
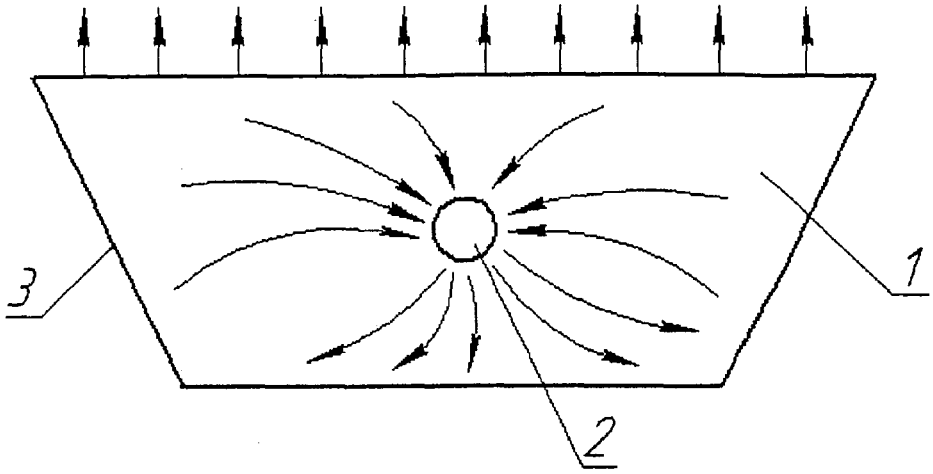
FIG. 1 illustrates the first stage of a solidification process model.

It is common knowledge that, all other conditions being the same, rising pressure in a majority of melts results in a corresponding increase in the initial solidification temperature:

$$\Delta T_{sol}^{Pi}=T_{sol}^{Po}+\Sigma_{k=1}^{n}\alpha_k P_k^k \tag{4}$$

wherein:

$T_{sol}^{Pi}$ and $T_{sol}^{Po}$ are solidification temperatures at pressures $P_0$ и $P_x$, respectively; and α is a derivative dt/dP of the relationship $T_{sol}=f(P)$.

generally, relationship (4) may be nonlinear, but it may be assumed, with a reasonable degree of accuracy sufficient in practice, that k=1. Analysis of relationship (4) shows that raising $P_x$ in a localized zone of slightly overheated melt 1 initiates, upon successive uniform cooling of the melt, preferred commencement of solidification (that is, hardening) thereof in this particular zone. It follows, therefore, that the emerging solidification front will advance from this zone to the remaining part of the melt. This model is illustrated in FIG. 1. The artificial elevated pressure zone 2 in melt 1 will act in the manner of a pump that "pumps" through itself the liquid overheated melt until it is fully solidified. The melt moves in this manner because fragments of crystalline structures (in the elevated pressure zone) forming in the gravitational field of the earth have a higher density than the surrounding melt and settle on the mold bottom, activating the melt and forming a forced solidification zone between the mold bottom and the elevated pressure zone.

Melt 1 moves at cooling until the content of the lined mold 3 becomes uniform. The melt viscosity rises at that moment, which means that the first stage of the solidification process is completed.

Figure 2:
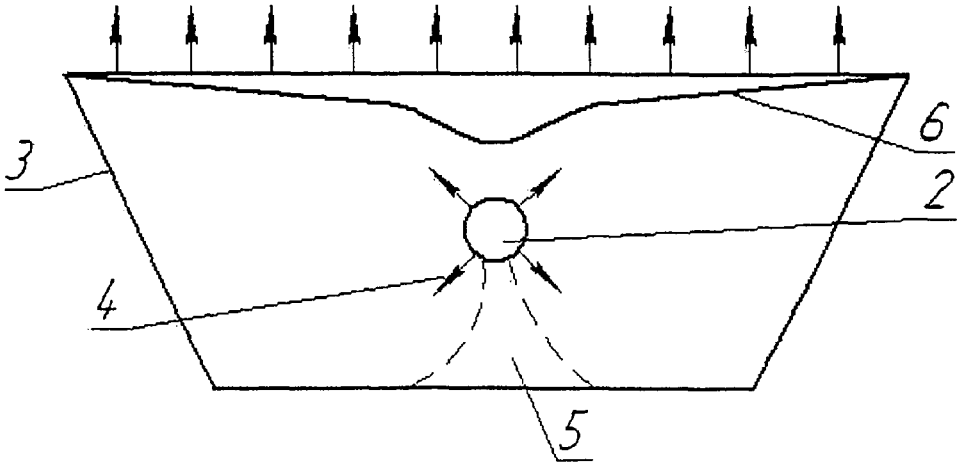
FIG. 2 illustrates the second stage of a solidification process model.

The second stage of the solidification process is illustrated in FIG. 2. It is characterized by the emergence of a solidification front 4 in the elevated pressure zone 2, the solidification front moving toward the periphery of the mold 3.

As solid phase formation is completed, a shrinkage cavity 5 of a larger size than one forming during natural solidification begins to form over the elevated pressure zone 2. The location of the shrinkage cavity 5 can be changed by moving the location of the elevated pressure zone 2.

In the absence of gravity, solidification is to be expected to commence in the elevated pressure zone, in which case the forced solidification zone and the first stage of the solidification process will not develop. An elevated pressure zone 4 is formed in the pressure antinode of interfering ultrasonic waves focused on the selected melt zone. In the experiment described, an aluminum melt was irradiated through concentrators provided at the shorter ends of the mold. A note is to be made, though, that an unidentified physical mechanism probably operated in addition to pressure elevation in the elevated pressure zone as the melt was irradiated with ultrasonic waves. Conductivity electrons moving at speeds above that of ultrasonic waves release some of their kinetic energy to the melt. In the case of this experiment, as a "standing" wave is produced, no ultrasonic wave energy is transported, and conditions favoring kinetic electron energy removal exist even if the melt is only slightly overheated. This, in turn, results in an overall decrease of the energy level of the melt, that is, commencement of the solidification process.

In the experiment described herein, the melt was irradiated with sine-shaped signals from two ultrasonic wave sources $U_1$ and $U_2$ (1) (2) at a controlled phase difference. Location of the elevated pressure zone (4) in the melt is determined from the initial phase difference (3), and was found to vary by 20 to 30 mm during the experiment, and, accordingly, the location of the forming shrinkage cavity varied as well.

The invention was effected on an experimental casting machine by making a series of castings and studying the structure of the castings obtained.

Figure 3:
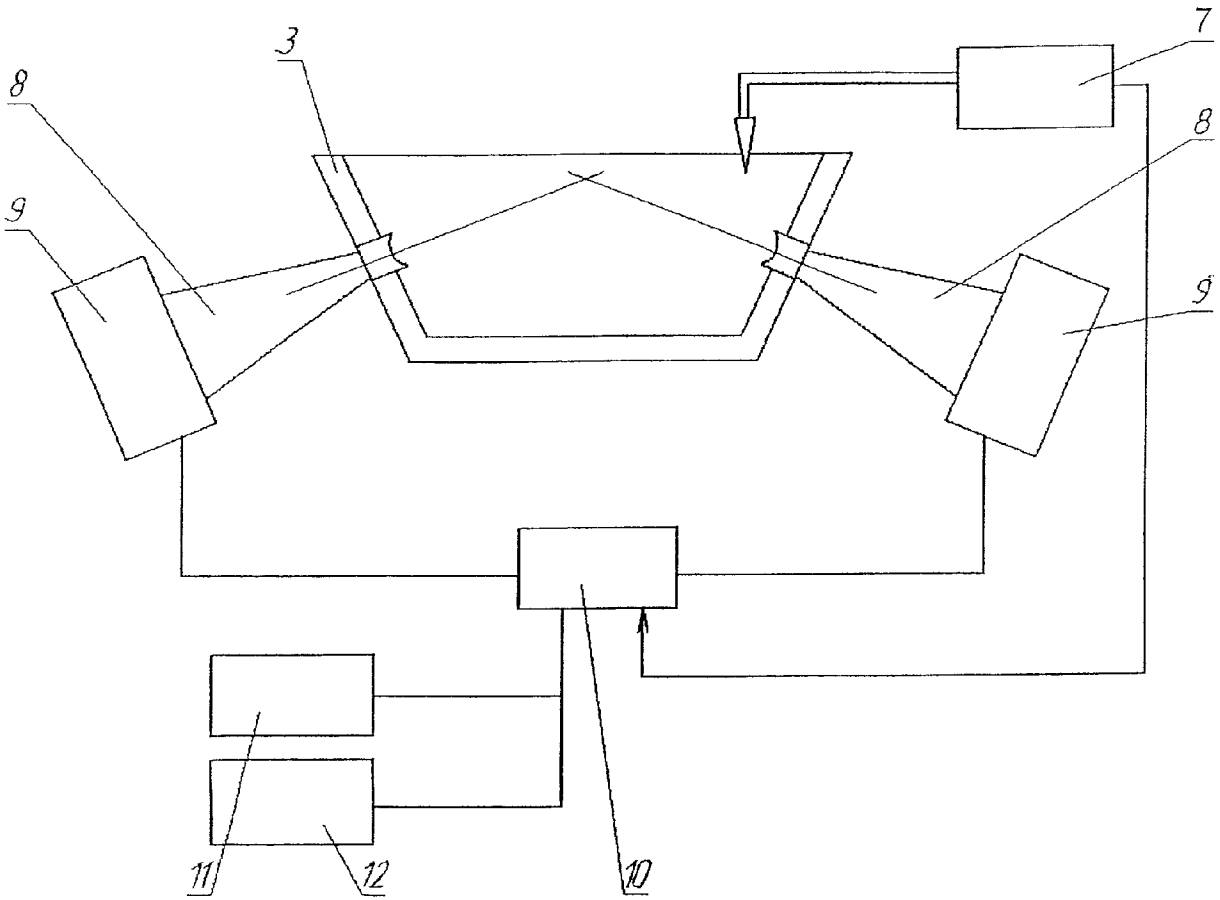
FIG. 3 is a diagram of an experimental apparatus to subject a melt to ultrasonic treatment.
Figure 5:
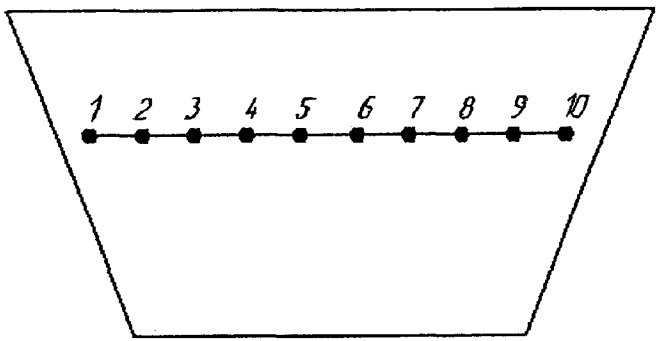
FIG. 5 is a diagram of casting hardness measurement points.

The experimental casting machine is shown diagrammatically in FIG. 3. The machine comprises a mold 3 lined to reduce the volume cooling rate of the melt to below 0.5° C./sec. Cooling rate limitation and the overheating temperature of the melt poured into the mold are together required to sustain the liquid phase of the melt for a time sufficient for prioritized directed solidification to advance from a selected point toward the periphery until natural melt solidification processes commence as the melt cools. The mold 3 has the shape of an overturned truncated pyramid to be filled with an melt of aluminum alloy AL5E at a temperature 20 to 25° C. above the solidification temperature $T_{sol}$ thereof. As the melt cools to a temperature 5 to 7° C. above the solidification point, a temperature meter 7 sends a signal to an ultrasonic generator 10. The ultrasonic generator 10 produces coherent signals $U_1$ and $U_2$ and sends them to two ultrasonic transmitters 9 that are acoustically linked with the unlined wall portions of the mold 3 through concentrators 8, the signals $U_1$ and $U_2$ being in opposite phases. The working zone of the mold 3 is dimensioned to have a length of 200 mm between the transmitters 9, a width of 90 mm (at casting grades of 5°), and a depth of 90 mm. The phases and amplitudes of the signals $U_1$ and $U_2$ were measured by a two-ray oscillograph 11 of model S12-69. The wave frequency was measured by a frequency meter 12, model CH3-38, and was found to be 65 kHz. The temperature was measured by platinum-rhodium-platinum thermocouples 7, model PP-1, and a device of model KSP-4. The transmitters comprised structural ceramic plates PTS-19, each 9 mm thick. Together with frequency reducing pads and concentrators 8, they resonated at a frequency of 65 kHz. The concentrators 8 were designed as round rods having an exponentially variable cross-section. After a series of six experimental heats in the machine described above, castings were produced from aluminum alloy AL5E. Microstructure studies and comparisons with the control castings produced the following results: the melt was irradiated with focused ultrasonic waves, producing castings having distinguishable large columnar crystals fanning out from a single point toward the periphery, the point being the solidification center. Several hardness measurements were taken on the resultant castings. The location diagram of hardness measurement points is shown in FIG. 5, and the results obtained for six samples are given in Table 1. Since the hardness of the samples obtained from this alloy in standard conditions in the absence of heat treatment did not rise above the range of 20 to 22 units, the present invention, therefore, produced an almost threefold increase in the harness of the alloy AL5E. The microstructure of the castings obtained in a series of heats was distinguished by a high isotropy of its properties and recurrence.

TABLE 1

| Sample | Measurement number | | | | | | | | | |
|---|---|---|---|---|---|---|---|---|---|---|
| number | 1 | 2 | 3 | 4 | 5 | 6 | 7 | 8 | 9 | 10 |
| 1 | 62.4 | 65.5 | 65.5 | 65.5 | 67.1 | 67.1 | 65.5 | 65.5 | 65.5 | 63.9 |
| 2 | 60.9 | 60.9 | 63.9 | 62.4 | 60.9 | 62.4 | 65.5 | 65.5 | 63.9 | |
| 3 | 62.4 | 62.4 | 63.9 | 65.5 | 65.5 | 63.9 | 65.5 | 65.5 | 63.9 | |
| 4 | 65.5 | 68.8 | 63.9 | 65.5 | 63.9 | 62.4 | 65.5 | 68.8 | 68.8 | 65.5 |
| 5 | 62.4 | 63.9 | 65.5 | 68.8 | 65.5 | 65.5 | 68.8 | 65.5 | 65.5 | |
| 6 | 65.5 | 65.5 | 65.5 | 67.1 | 67.1 | 67.1 | 67.1 | 67.1 | 65.5 | |

The method of this invention allows a single solidification front (established at the melt center) moving toward the periphery to push unbound intermetallic compounds and organic and pseudo-organic inclusions to the casting surface and eliminate the causes of blow holes and shrinkage cracks, a particularly useful advantage in the manufacture of large-size castings.

INDUSTRIAL APPLICABILITY

The present invention can be used for making any type of castings in molds of a suitable design in which the natural melt cooling rate is maintained at a level that does not exceed 0.5° C./sec, combined with slight overheating of the melt poured into the mold and directed solidification advancing from a selected melt zone toward the mold periphery in a nonuniform field of force, which all together help to significantly improve the quality of semifinished products and articles. The invention can be used with best effect in manufacturing large-size ingots that are then rolled into sheets or similar products, or used as blanks for the needs of metal machining centers, and also in producing shaped castings of any geometry.

The invention claimed is:

1. A method for making castings by directed solidification of a melt advancing from a selected point thereof toward the periphery, comprising using a stationary mold to form a casting by uniform volume cooling of the melt in a nonuniform field of force, wherein the nonuniform field of force is produced by ultrasonic waves focused on a selected zone totally within the melt volume and a localized elevated pressure zone is formed therein, a solidification center is set up in said localized elevated pressure zone, and a solidification front is directed from said localized elevated pressure zone toward the periphery of the casting.

2. A method as claimed in claim 1, wherein uniform volume cooling of the melt is effected at a rate not exceeding 0.5° C./sec.

3. A method as claimed in claim 1, wherein the extent of overheating of the melt poured into the mold is selected so as to sustain a liquid phase of the melt for a time sufficient to complete directed melt solidification from a selected point toward the periphery of the casting until natural melt solidification processes commence as the melt cools.

4. A method as claimed in claim 1, wherein the nonuniform field of force is removed as the casting temperature reaches the point at which natural solidification processes are completed, and casting cooling is continued.

* * * * *